US007932878B2

(12) United States Patent
Shikina

(10) Patent No.: US 7,932,878 B2
(45) Date of Patent: Apr. 26, 2011

(54) ACTIVE MATRIX-TYPE DISPLAY APPARATUS AND INFORMATION PROCESSING APPARATUS USING THE SAME

(75) Inventor: Noriyuki Shikina, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 984 days.

(21) Appl. No.: 11/763,667

(22) Filed: Jun. 15, 2007

(65) Prior Publication Data

US 2008/0001858 A1 Jan. 3, 2008

(30) Foreign Application Priority Data

Jun. 30, 2006 (JP) ..... 2006-181672

(51) Int. Cl.
*G09G 3/12* (2006.01)

(52) U.S. Cl. ..... 345/76

(58) Field of Classification Search ..... None
See application file for complete search history.

(56) References Cited

U.S. PATENT DOCUMENTS 6,040,814 A 3/2000 Murakami et al. ..... 345/94
6,373,454 B1 4/2002 Knapp et al. ..... 345/76

FOREIGN PATENT DOCUMENTS

JP 9-81089 3/1997
JP 2005-140883 6/2005
JP 2007-219342 8/2007
JP 2007-279156 10/2007

*Primary Examiner* — Sumati Lefkowitz
*Assistant Examiner* — Tammy Pham
(74) *Attorney, Agent, or Firm* — Fitzpatrick, Cella, Harper & Scinto

(57) ABSTRACT

An active matrix-type display apparatus comprises: pixel circuits arranged in a row and a column directions; a column current control circuit that generates a current signal; an information line that transmits the current signal from the column current control circuit to the pixel circuits arranged in the column direction; and a light emitting element that is supplied with current corresponding to the current signal, from one of the pixel circuits, wherein the column current control circuit has an information storage circuit and compares an information stored in the information storage circuit with an information newly input into the column current control circuit, converts the newly input information to a converted information according to the comparison result and generates the current signal on the basis of the converted information.

3 Claims, 9 Drawing Sheets

ACTIVE MATRIX-TYPE DISPLAY APPARATUS AND INFORMATION PROCESSING APPARATUS USING THE SAME

BACKGROUND OF THE INVENTION

1. Field of the Invention

The present invention relates to an active matrix-type display apparatus, for example, a display apparatus such as an organic electroluminescence (EL) display apparatus and an information processing apparatus using the same.

2. Description of the Related Art

A flat display apparatus formed of current driven type light emitting elements such as EL elements has pixels arranged in plural rows and columns and commonly connected to scanning lines on a row basis and data lines on a column basis. Such a flat display apparatus generally uses a matrix driving in which a row scanning circuit selects each scanning line and at the same time a column scanning circuit applies a predetermined display signal to each data line to cause pixels in the selected row to be subjected to a predetermined display.

A current setting method is known as a method of driving an active matrix-type display apparatus formed using EL elements. The current setting method writes data current into a pixel circuit and controls current flowing into an EL element based on the written data current to adjust light emission intensity of each pixel. An active matrix EL display device using the current setting method is disclosed in U.S. Pat. No. 6,373,454.

FIG. 13 illustrates a schematic configuration of the EL display apparatus. The display apparatus includes a column current control circuit 101, scanning line driving circuit 102 and pixel circuit 103.

FIG. 14 illustrates an example of a pixel circuit with an EL element. Reference characters P1 and P2 denote scanning signal lines. Current data "Idata" being an information signal is input into an information line. The anode of the EL element ("A" in FIG. 14) is connected to the drain terminal of a thin film transistor (TFT) M4 and the cathode thereof ("K" in FIG. 14) is connected to a ground potential CGND. The pixel circuit further includes p-type thin film transistors (PMOS transistors) M1, M2 and M4 and an n-type thin film transistor (NMOS transistors) M3.

The following describes the operation of the pixel circuit in FIG. 14.

When the current data Idata is input, a HIGH level signal is input into the scanning signal line P1 and a LOW level signal is input into the scanning signal line P2. Then, the transistors M2 and M3 are turned on and the transistor M4 is turned off. At this point, the transistor M4 is not in a conductive state, which causes a current not to flow into the EL element. The current data Idata generates a voltage according to the current driving ability of the transistor M1 across a capacitance C1 arranged between the gate terminal of the transistor M1 and the power source potential Vcc. Thus, a current, which is caused to flow in the EL element during the light emission period of the EL element, is held as the gate voltage of the transistor M1.

When a current needs to be supplied to the EL element, a LOW level signal is input into the scanning signal line P1 and a HIGH level signal into the scanning signal line P2. At this point, the transistor M4 is turned on and the transistors M2 and M3 are turned off. Since the transistor M4 is in a conductive state, by a voltage generated across the capacitance C1, a current according to the current driving ability of the transistor M1 is supplied to the EL element. This causes the EL element to emit light with brightness according to the supplied current.

The active matrix-type display apparatus with the above configuration has a problem with display blur having tailing effect.

The display blur having tailing effect occurs when the maximum current and the minimum current are caused to flow into a certain information line in this order. In this case, a little larger current is programmed for a pixel which should be programmed with the minimum current, thereby causing the EL element to emit light with a little higher brightness.

On the other hand, the display blur having tailing effect also occurs when the minimum and the maximum current are caused to flow into a certain information line in this order. In this case, a little smaller current is programmed for a pixel which should be programmed with the maximum current, thereby causing the EL element to emit light with a little lower brightness.

This is partly because the output of the column current control circuit 101 attempts to cause current Idata to flow according to an information signal, however, parasitic capacitance and resistance existing in the information line round a current waveform, which insufficiently accumulates charges into the capacitance C1.

SUMMARY OF THE INVENTION

The active matrix-type display apparatus according to an aspect of the present invention includes pixel circuits arranged in a row and a column directions; a column current control circuit that generates a current signal; an information line that transmits the current signal from the column current control circuit to the pixel circuits arranged in the column direction; and a light emitting element that is supplied with current corresponding to the current signal, from one of the pixel circuits, wherein the column current control circuit has a latch circuit to store an information, and wherein the column current control circuit compares the stored information in the latch circuit with an information newly input into the column current control circuit, converts the newly input information to a converted information according to the comparison result and generates the current signal on the basis of the converted information.

According to one aspect of the present invention, the information stored in the latch circuit is an information input into the column current control circuit immediately preceding to the newly input information or a converted information thereof according to the comparison result between the immediately preceding information and the information stored in the latch circuit when the immediately preceding information is input into the column current control circuit.

According to another aspect of the present invention, the column current control circuit includes a lookup table for storing a compensation information determined from the newly input information and the information stored in the latch circuit and outputs the converted information such that the compensation information is added to the newly input information.

According to the present invention, controlling a writing current or a correcting current for the information line enables reducing the rounding of the current waveform, caused by parasitic capacitance and resistance existing in the information line, thereby reducing the display blur having tailing effect.

The present invention is applied to a display apparatus such as an EL display apparatus provided with a plurality of column current control circuits for supplying, on a column basis, signal current to a plurality of light emitting elements two-dimensionally arranged on a column basis. The present invention is applied to a cellular phone, mobile computer, still camera, video camera using such a display apparatus or information processing apparatus realizing plural functions thereof.

Further features of the present invention will become apparent from the following description of exemplary embodiments with reference to the attached drawings.

DESCRIPTION OF THE EMBODIMENTS

Exemplary embodiments of the present invention are applied to an active matrix-type display apparatus using EL elements and described in detail hereinafter with reference to the drawings.

First Embodiment

Figure 2:
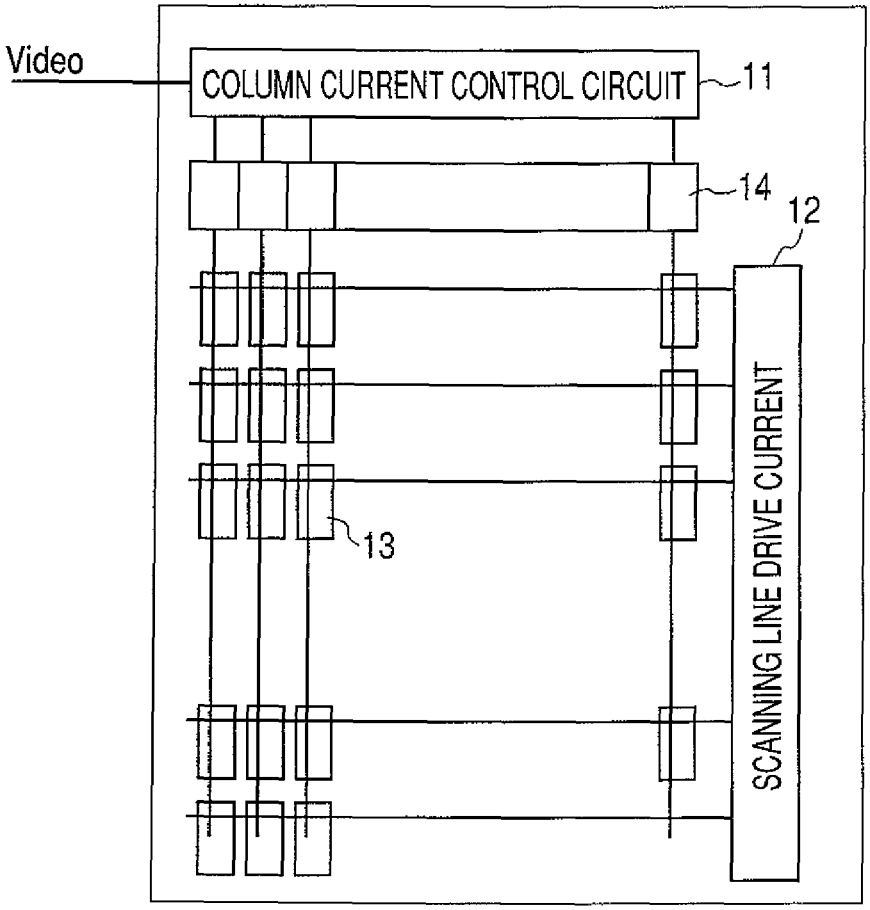
FIG. 2 is a schematic diagram of a display apparatus according to the first embodiment of the present invention.

FIG. 2 illustrates a display apparatus according to the first embodiment of the present invention.

The display apparatus of the present embodiment includes a column current control circuit 11 for outputting data current "Idata" to an information line, scanning line drive circuit 12 for driving scanning lines and pixel circuit 13 for controlling current flowing into the EL elements in accordance with the data current Idata values. It further includes a column current circuit (correcting current setting circuit) 14 for outputting current Iz to the information line. The Information line transmits the current signal Iz output from the column current circuit to the pixel circuit.

The pixel circuits are arranged in a matrix form in the row and the column directions.

Figure 14:
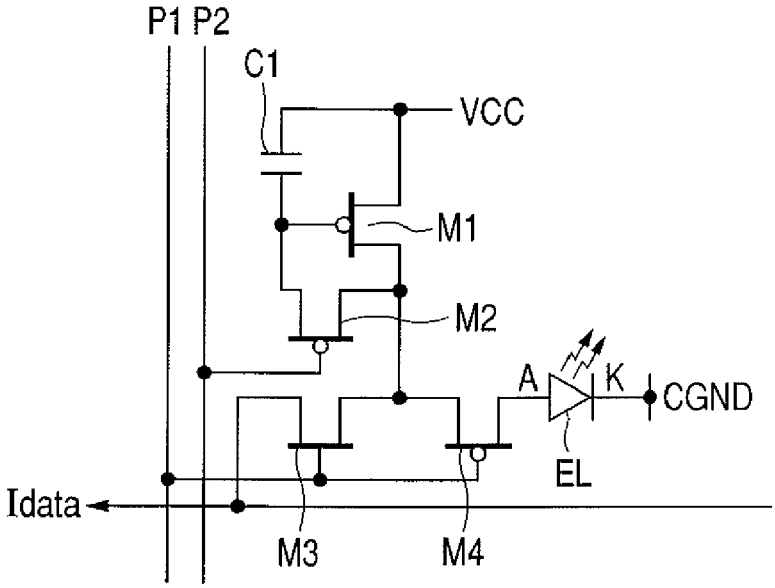
FIG. 14 is an example of a pixel circuit with an EL element in conventional art.

Since the pixel circuit with the EL element in the present invention is the same in configuration as that in FIG. 14, the configuration and operation thereof are omitted. In the present embodiment, the configuration in FIG. 14 is cited as an example of a pixel circuit, however, it is not limited to this example.

Figure 3:
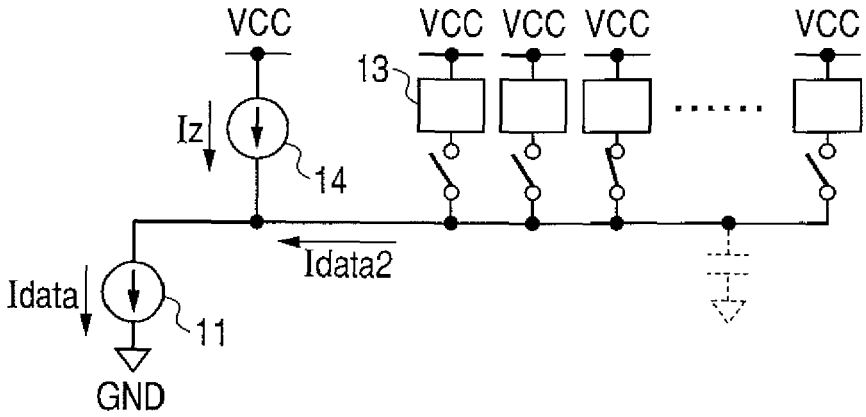
FIG. 3 is a diagram illustrating relationship among the column current circuit, pixel circuit and column constant current circuit according to the first embodiment of the present invention.

FIG. 3 is a schematic diagram illustrating relationship among the column current control circuit 11, pixel circuit 13 and column current circuit 14 illustrated in FIG. 2.

A current "Idata2" (=Idata−Iz) in which the output current Iz of the column current circuit 14 is subtracted from the data current Idata of the column current control circuit 11 flows into the information line and pixel circuit. The output current Iz is set to be equal to the data current Idata when an image data signal of "0" is input. The output current Iz is set once a frame by taking a vertical blanking period.

Figure 1:
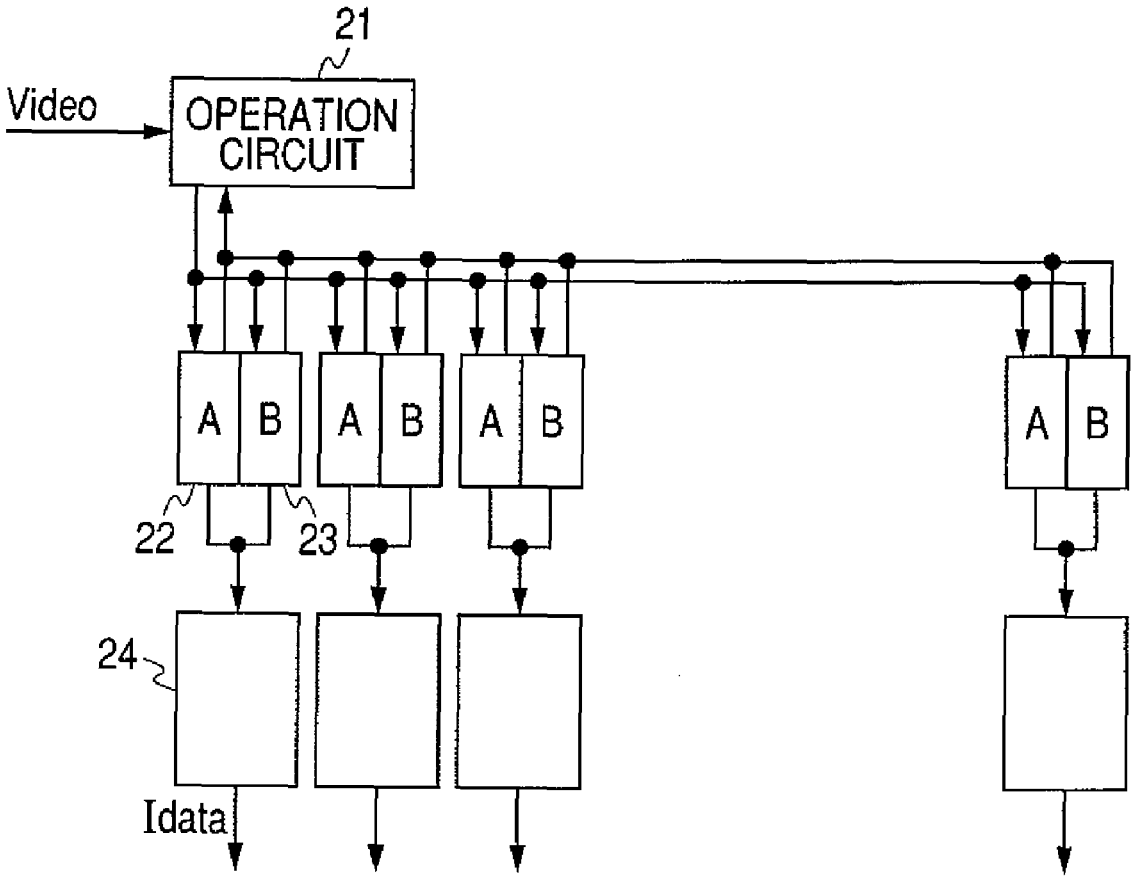
FIG. 1 is a functional block diagram of a column current circuit according to a first embodiment of the present invention.

FIG. 1 is a configurational block diagram of the column current control circuit 11 which is a feature of the present embodiment. The column current control circuit 11 includes an operation circuit 21 which performs operation with reference to a newly input Video signal (image information $D_n$) and a video signal preceding by one scanning period (image information $D_{n-1}$), a latch circuit A 22, a latch circuit B 23 and a voltage-current conversion circuit 24. The voltage-current conversion circuit 24 outputs a current signal Idata to the information line. The latch circuit A (a first latch circuit) 22, the latch circuit B (a second latch circuit) 23 and the voltage-current conversion circuit 24 are provided on a column basis.

Figure 4:
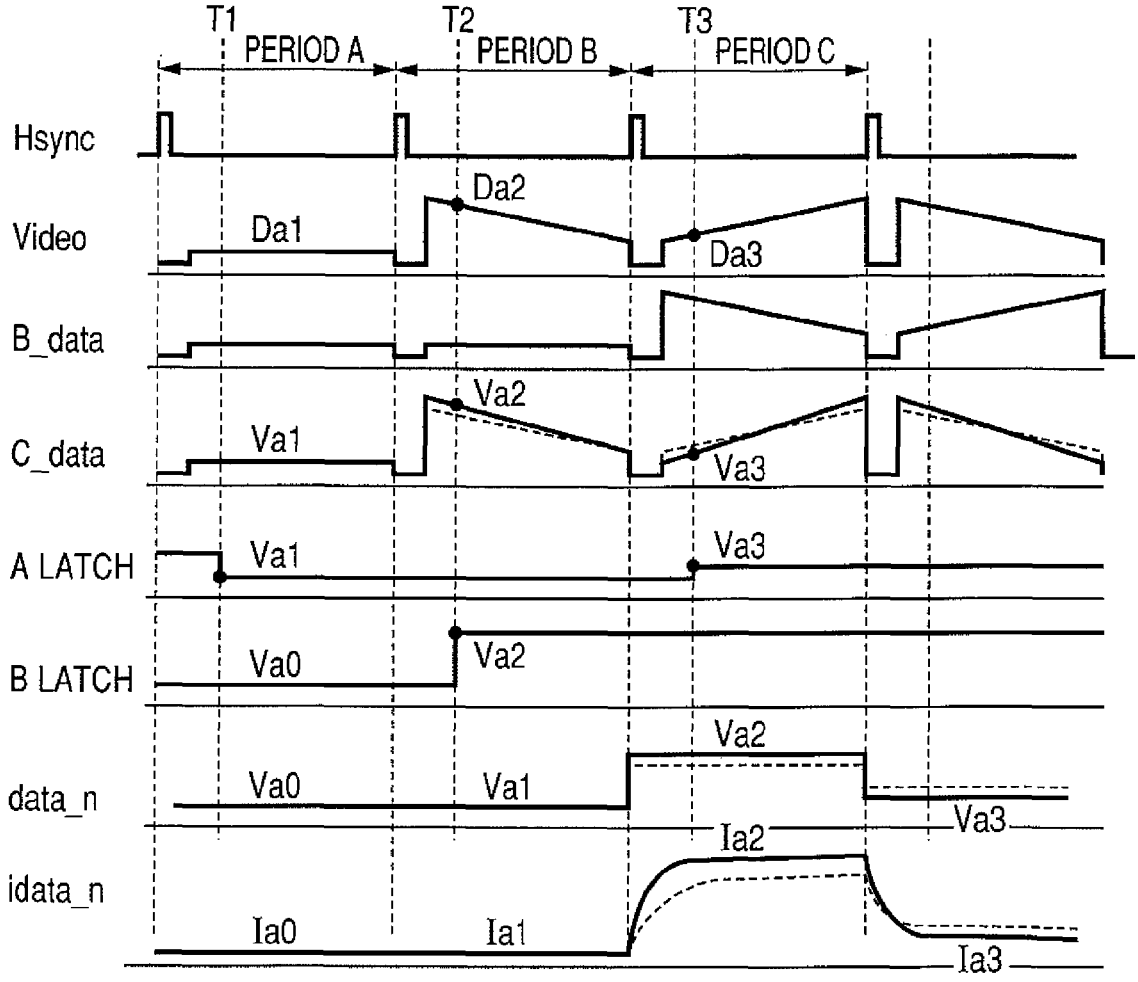
FIG. 4 is an operational timing chart according to the first embodiment of the present invention.

The operation of the column current control circuit 11 is described using a timing chart of FIG. 4. The receiving period of the image signal "video" supplied to the pixel circuits in the (k−1)th, the k-th and the (k+1)th row are taken to be periods A, B and C respectively. The video signals for the pixel circuits in the n-th column in each period are presumed to be received at the timing of time T1, T2 and T3. In the operation of the column current control circuit in FIG. 1, periods during which current written into the pixel circuits in the (k−1)th and the k-th row is output are shifted by one horizontal period to be periods B and C respectively.

A video signal Da2 (an image information of the pixel circuit in the k-th row and the n-th column) received at the timing of time T2 is subjected to operation by the operation circuit 21 as described later and then stored in the latch circuit B 23 as Va2. During this operation, Va1 stored in the latch circuit A 22 is referred to. Reference character Va1 denotes a writing information determining a current signal supplied to the pixel circuit in the (k−1)th row and the n-th column.

Hereinafter, the image signal ("video" in FIG. 1) input from the outside is referred to "image information" and a voltage signal being a source of the current signal "Idata" output from the column current control circuit to the information line is referred to as "writing information." The writing information is such information that is converted from the image information inside the column current control circuit as described below.

A video signal Da3 received at the timing of time T3 is subjected to operation in the operation circuit 21 as described later and then stored in the latch circuit A 22 as Va3. During this operation, Va2 stored in the latch circuit B 23 is referred to.

The writing information Va1 stored in the latch circuit A 22 at time T1 or later, Va2 stored in the latch circuit B 23 at time T2 or later and Va3 stored in the latch circuit A 22 at time T3 or later are sequentially output to the voltage-current conversion circuit 24. The voltage-current conversion circuit 24 generates current signals Ia1, Ia2 and Ia3 according to those voltage signals and output them to the information lines.

The current signals Ia1, Ia2 and Ia3 are current written into pixel circuits in the (k−1)th, the k-th and (k+1)th row. The current signal Ia2 synthesized in the period C is larger than the current signal (Idata shown by dotted lines in FIG. 4) directly generated from the Video signal and drives the information line. Consequently, a writing shortage is reduced which was caused by the parasitic capacitance of the information line.

The operation circuit 21 modifies image information to be larger when the image information in the (k−1)th row input from the outside generates a large current signal and the image information in the following k-th row corresponds to a small current signal. However, information to be compared as an information preceding by one row is not image information, but writing information corresponding to current actually output to the information line, so that input image information is compared with the writing information preceding by one row, that is, the writing information $V_{n-1}$ preceding by one row input from the latch circuit A or B.

In practice, the operation circuit 21 compares the input image information $D_n$ with the writing information $V_{n-1}$ preceding by one row, outputs $V_n=D_n+\alpha(\alpha>0)$ if $D_n-V_{n-1}\geqq S1$ and outputs $V_n=D_n-\beta(\beta>0)$ if $D_n-V_{n-1}\leqq S2$. In addition, the operation circuit 21 outputs $V_n$ if $S2\leqq D_n-V_{n-1}\leqq S1$ with $V_n$ considered to be equal to $D_n$.

Where, S1 and S2 are appropriately set parameters denoting a degree of how far away signals in two rows are.

In a display apparatus with a panel size of three inches and the number QVGA of pixels, S1 is taken to be S1=the maximum data value×90%, S2 is taken to be S2=−the maximum data value×90% and α and β is taken to be α=β=the maximum data value×10%. The values S1, S2, α and β vary with characteristics of a display apparatus, such as wiring resistance, parasitic capacitance components and frame rate as well as panel size and the number of pixels. The values are adjusted while being correlated with optical response and determined for each display apparatus with each specification.

Figure 11:
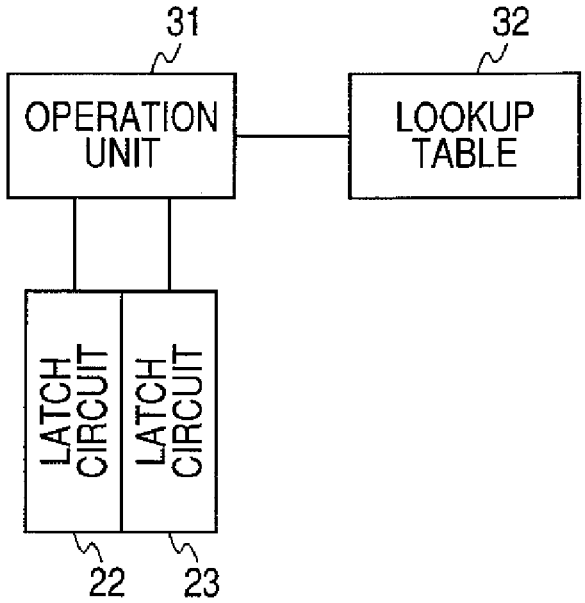
FIG. 11 is an example of configuration of an operation circuit.

The operation circuit 21 has a subtracting unit for executing a process of $D_n-V_{n-1}$ and a comparing unit for determining $D_n-V_{n-1}\geqq S1$ and $D_n-V_{n-1}\leqq S2$. Furthermore, the operation circuit 21 has an operation unit which performs addition of $D_n+\alpha$ to set $V_n=D_n+\alpha$ if $D_n-V_{n-1}\geqq S1$, subtraction of $D_n-\beta$ to set $V_n=D_n-\beta$ if $D_n-V_{n-1}\leqq S2$ and sets $V_n$ to be equal to $D_n$ if $S2<D_n-V_{n-1}\leqq S1$. The operation circuit 21 is typically formed as illustrated in FIG. 11. The operation circuit 21 in FIG. 11 includes a lookup table 32 used for deriving compensation information En (+α and −β) from signal values of the image information $D_n$ and the writing information $V_{n-1}$ and an operation unit 31 for adding the compensation information to the Video signal and outputting it.

Figure 9:
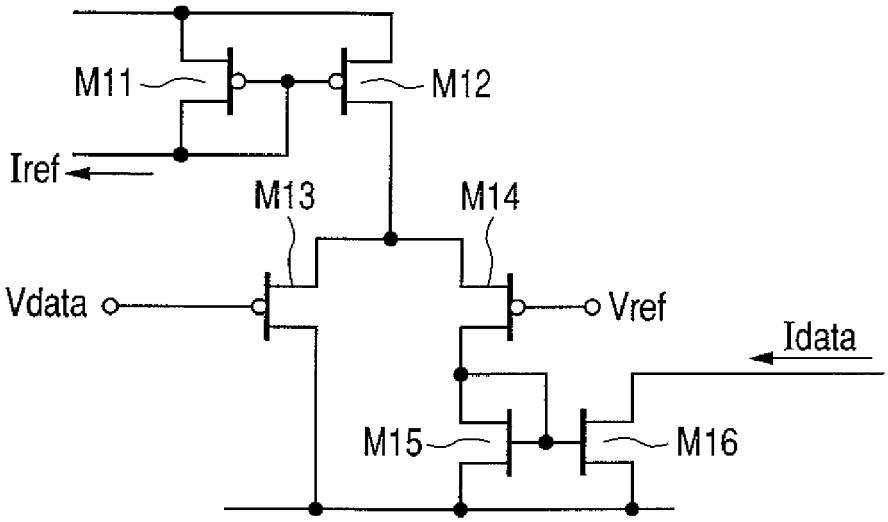
FIG. 9 is an example of configuration of a voltage-current conversion circuit according to the second embodiment of the present invention.

FIG. 9 is an example of configuration of a voltage-current conversion circuit 24 according to the present embodiment.

In the figure, reference characters M11 to M16 denote transistors, Iref signifies reference current, Vdata represents writing information $V_n$ and Idata indicates data current. Incidentally, the configuration in FIG. 9 is cited as an example of a voltage-current converting circuit, however, it is not limited to this example.

Figure 5:
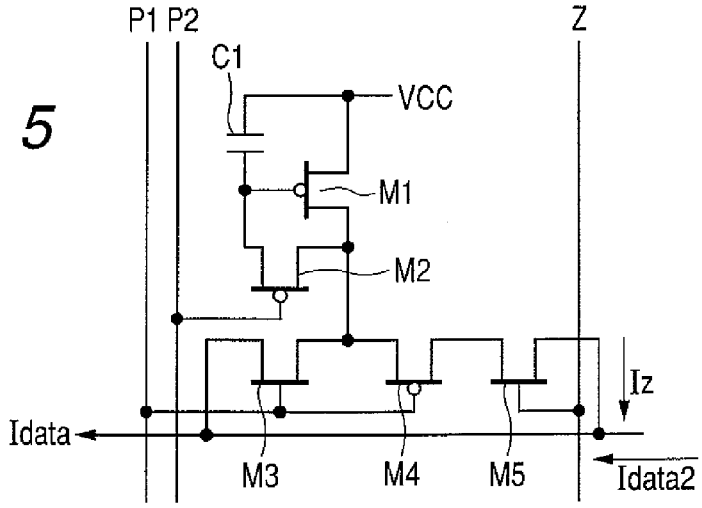
FIG. 5 is an example of configuration of column correction current circuit according to the first embodiment of the present invention.

FIG. 5 is an example of configuration of the column current circuit 14 according to the present embodiment. The constituent elements illustrated in FIG. 5 which are the same as those in FIG. 14 are denoted by the same reference characters as those in FIG. 14. The circuit in FIG. 5 operates in the same manner as that in FIG. 14, but is different in that a transistor M5 is provided instead of the EL element. When the output current Iz is set, the circuit is operated in the same manner as that in inputting data current Idata into the pixel circuit in FIG. 14 and the transistor M5 is turned off by the scanning signal Z. When the output current Iz is output, the circuit is operated in the same manner as that in supplying current to the EL element in the pixel circuit in FIG. 14 and the transistor M5 is turned on.

Second Embodiment

In the present embodiment also, the following description is made with reference to the display apparatus illustrated in FIG. 1.

Figure 6:
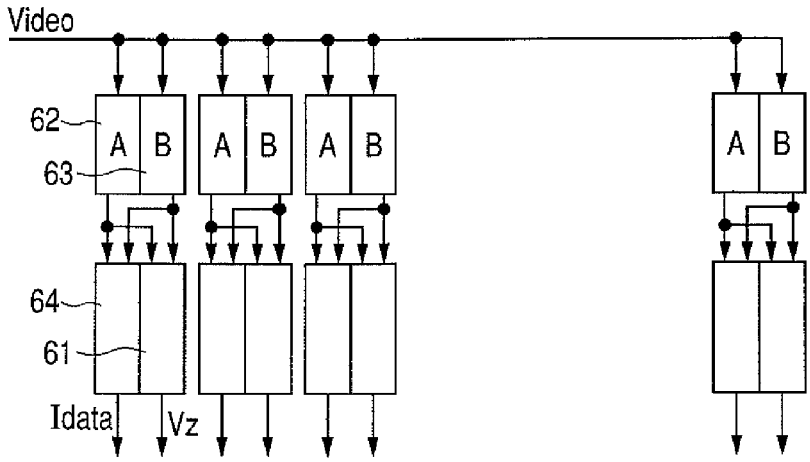
FIG. 6 is a functional block diagram of a column current circuit according to a second embodiment of the present invention.

FIG. 6 is a block diagram of a column current control circuit 11 according to the present embodiment. The column current control circuit 11 includes an operation circuit 61 which performs operation with reference to a newly input Video signal and a video signal preceding by one scanning period, a latch circuit A 62, a latch circuit B 63 and a voltage-current conversion circuit 64 that serves as a current setting circuit.

The operation circuit 61 outputs a voltage signal $V_z=V_{st}+V_E$ applied to the column current circuit described below. Where, $V_E$ is set to $V_E=-\beta$ if $D_n-D_{n-1}\leqq S1$ and to $V_E=\alpha$ at if $D_n-D_{n-1}\geqq S2$ (α and β are a constant value). The voltage signal $V_z$ is set to $V_z=V_{st}$ if $S1<D_n-D_{n-1}<S2$. The values S1, S2, β and α are set in the same manner as those in the first embodiment. $V_{st}$ is set so that the column current circuit 14 in FIG. 7 described below outputs the current Iz equal to the data current Idata when an image data signal of "0" is sequentially input.

Although one block of an operation circuit 61 is provided for each column in FIG. 6, it is not limited to this configuration. A single operation circuit 61 is provided and circuits for latching operation results may be provided for each column.

Figure 7:
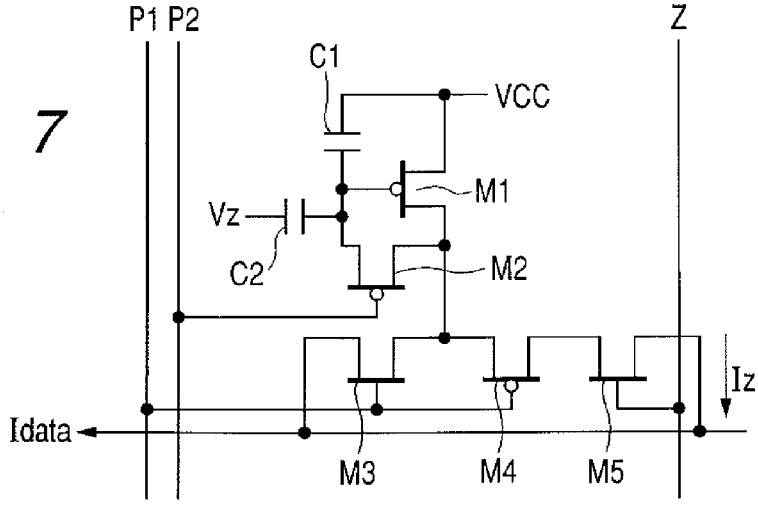
FIG. 7 is an example of configuration of a column correction current circuit according to the second embodiment of the present invention.

The column current circuit 14 in the present embodiment is different from that in the first embodiment. FIG. 7 is an example of configuration of the column current circuit 14 according to the present embodiment. Reference characters P1, P2 and Z denote scanning signal lines and current data "Idata" is input as information signal. The column current circuit includes p-type TFTs M1, M2 and M4, an n-type TFTs M3 and M5 and capacitances C1 and C2. One end of the capacitance C2 is connected to the Vz terminal and the other end thereof is connected to the capacitance C1 and the gate terminal of the transistor M1. The Vz terminal is connected to the operation circuit 61 in FIG. 6. The operation of the column current circuit is described below.

When the current data Idata is input, a HIGH level signal is input into the scanning signal line P1 and a LOW level signal is input into the scanning signal line P2. Then, the transistors M2 and M3 are turned on and the transistor M4 is turned off. In addition, a LOW level signal is input into the scanning signal Z. Then, the transistor M5 is turned off. Vst is being input into the input terminal of Vz. The current data Idata develops a voltage according to the current driving capability of the transistor M1 across a capacitance C1 arranged between the gate terminal of the transistor M1 and the power source potential Vcc.

When a current needs to be supplied, a LOW level signal is input into the scanning signal line P1 and a HIGH level signal into the scanning signal line P2 and the scanning signal Z. At this point, the transistors M4 and M5 are turned on and the transistors M2 and M3 are turned off. Since the transistor M4 is in a conductive state, by a voltage generated across the capacitance C1, current Iz is supplied to the information line according to the current driving ability of the transistor M1 through the transistor M5.

In the present embodiment, Vst, Vst+Vα, or Vst−Vβ is input into Vz. This makes the amount of change ΔV in electric potential applied across the gate terminal of the transistor M1 equal to Vα×C2/(C1+C2+Cgs), for example, where Cgs is capacitance between the gate and source of the transistor M5. Accordingly, a predetermined Iz can be increased or decreased.

Figure 8:
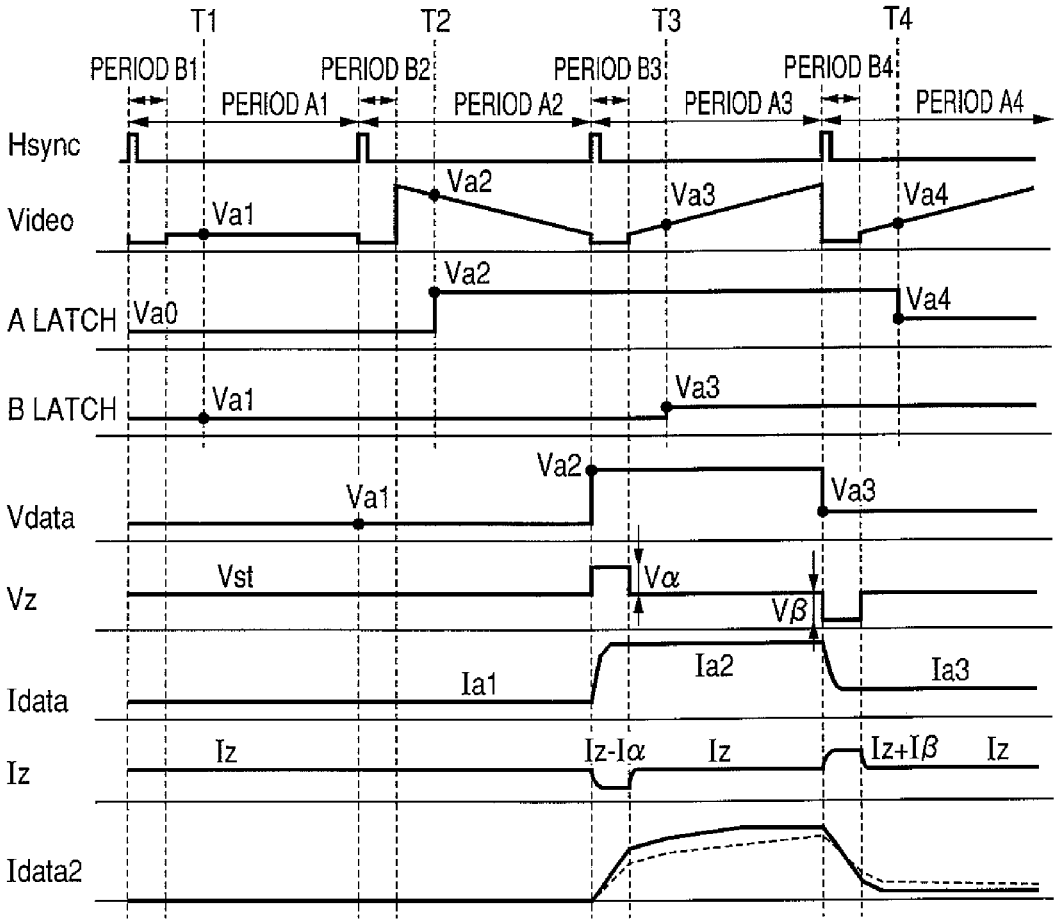
FIG. 8 is an operational timing chart according to the second embodiment of the present invention.

The operation of the column current circuit is described with reference to the timing chart illustrated in FIG. 8. Writing into pixels, for example, in the n-th column and the k-th row is described using the timing chart in FIG. 8. The receiving periods of video signal at a pixel group in the (k−1)th and the k-th rows are taken to be periods A1 and A2 respectively. The output periods of current written into the pixel group in the (k−1)th and the k-th rows are taken to be period A2 and A3 respectively. A signal corresponding to the n-th column is taken to be a Video signal received at the timing of T1, T2, T3, . . . Periods B1, B2, B3, . . . are taken to be a horizontal blanking period (or a preceding period) during which the Video signal is not input. Periods determined by removing the period B1 from the period A1, the period B2 from the period A2 and the period B3 from the period A3 are a period (or a succeeding period) during which the Video signal is input.

In writing into the pixel in the n-th column and the (k−1)th row in the period A2, the voltage-current conversion circuit 64 outputs Ia1 with reference to information Va1 (shown as a Video signal in the present embodiment) stored in the latch circuit B 63 at the timing of T1 in the period A1. At this point, in the period B, the operation circuit 61 compares Va1 stored in the latch circuit B 63 with Va0 stored in the latch circuit A 62 to modulate Vz. In this case, Va1 is equal to Va0, so that Vz becomes equal to Vst. As a result, a predetermined Iz is output from the column current circuit 14.

In writing into the pixel in the n-th column and the k-th row in the period A3, the voltage-current conversion circuit 64 outputs Ia2 with reference to information Va2 stored in the latch circuit A at the timing of T2 in the period A2. At this point, in the period B3, the operation circuit 61 compares Va2 stored in the latch circuit A with Va1 stored in the latch circuit B to modulate Vz. In this case, Va2−Va1 is greater than Vs2, so that Vz becomes equal to Vst+Vα. As a result, the column current circuit 14 outputs a current (Iz−Iα) smaller than a predetermined Iz. This effect supplies a current (Idata−Iz+Iα) to the information line in the n-th column at the period B3, which drives the pixel circuit with larger current as compared with the case where current is synthesized only with reference to the Video signal in related art (dotted line in FIG. 8). Consequently, a shortage of writing is reduced which was caused by the parasitic capacitance of the information line.

Third Embodiment

In the first embodiment, although the writing information $V_n$ is produced based on the image information $D_n$ and the immediately preceding writing information $V_{n-1}$, the writing information $V_n$ may be produced based on the image information $D_n$ and the preceding image information $D_{n-1}$ as is the case with the second embodiment. The configuration of the display apparatus in the present embodiment is the same as those in FIGS. 2 and 3.

Figure 10:
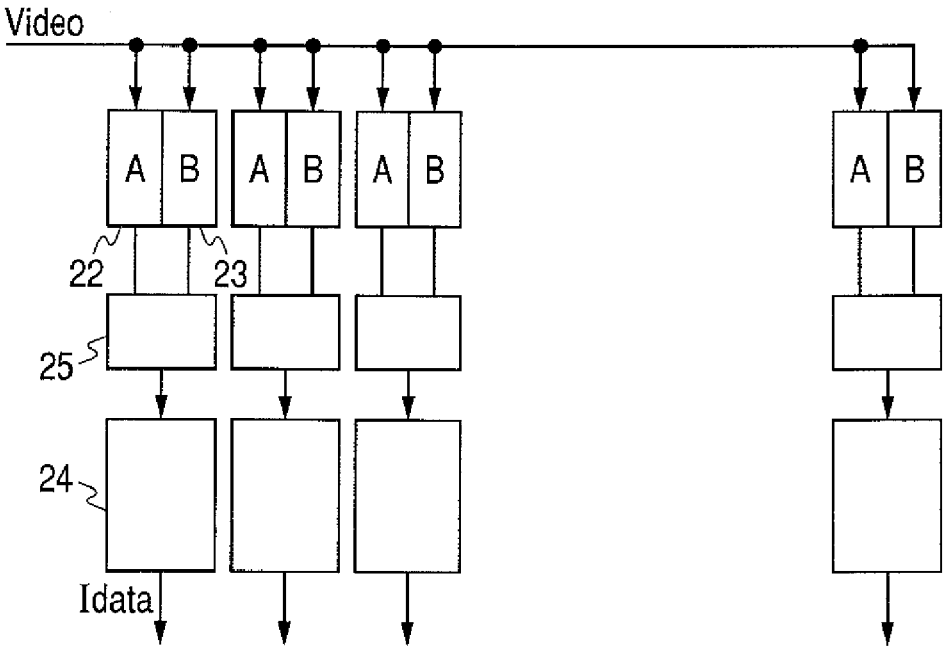
FIG. 10 is a functional block diagram of a column current control circuit according to a third embodiment of the present invention.

FIG. 10 is a block diagram illustrating the configuration of the column current control circuit 11 according to the present embodiment. The operation of the column current control circuit is the same as that described with reference to the timing chart illustrated in FIG. 4 except that the Video signal instead of a corrected voltage signal is stored in the latch circuit.

As illustrated in FIG. 10, the Video signal (Dn) is input into the latch circuit (B) 23. The Video signal ($D_{n-1}$) proceeding by one scanning period has been stored in the latch circuit (A) 22. The operation circuit 25 executes an operation of $V_n=D_n+\alpha'$ if $D_n-D_{n-1}\geqq S3$ and of $V_n=D_n-\beta'$ if $D_n-D_{n-1}\leqq S4$. $V_n$ is set to be equal to $D_n$ if $S3>D_n-D_{n-1}>S4$. Where, $D_n$ is a Video signal, $D_{n-1}$ is the Video signal ($D_{n-1}$) preceding by one scanning period and $V_n$ is a voltage signal written into the pixels in the present row. As is the case with the first embodiment, in a display apparatus with, for example, a panel size of three inches and the number QVGA of pixels, S3 is used as data of S3=the maximum data value×90%, S4 is used as data of S4=−the maximum data value×90% and α' and β' are used as data of α'=β'=the maximum data value×10%. The values S3, S4, α' and β' vary dependently on characteristics of a display apparatus, such as wiring resistance, parasitic capacitance components and frame rate as well as panel size and the number of pixels. The respective values are adjusted while being correlated with optical response and determined for each display apparatus with each specification. The voltage signal $V_n$ is output to the voltage-current conversion circuit 24.

Fourth Embodiment

Figure 12:
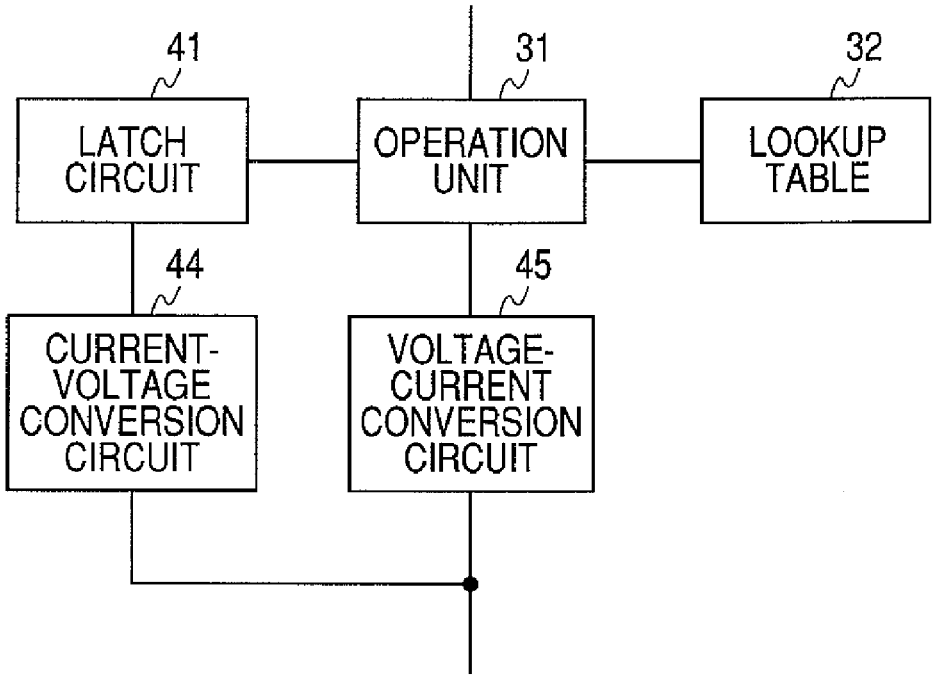
FIG. 12 is a functional block diagram of a column current control circuit according to a fourth embodiment of the present invention.
Figure 13:
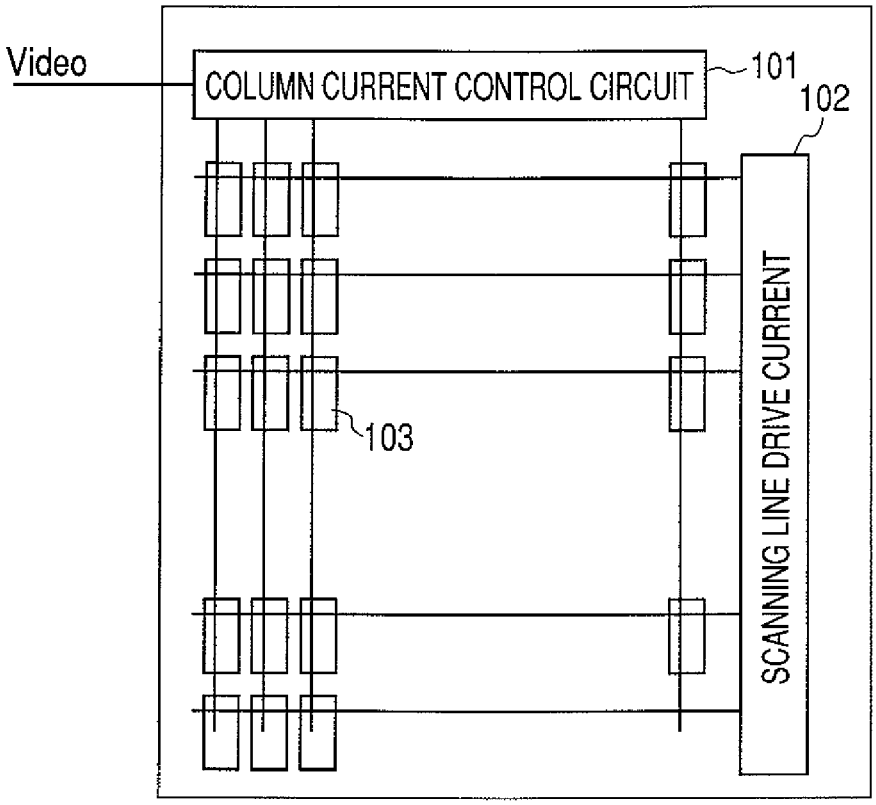
FIG. 13 is a schematic diagram of an active matrix-type display apparatus in conventional art.

FIG. 12 is a block diagram illustrating the configuration of a column current control circuit 11 according to the present embodiment. In the present embodiment, a part of current actually flowing into the information line and preceding by one scanning period is current-to-voltage converted by a current-voltage conversion circuit 44 and stored in a latch circuit 41 as writing information $V_{n-1}$. In the present application, such a writing information $V_{n-1}$ falls within "the immediately preceding writing information $V_{n-1}$ having been input into the current-voltage conversion circuit being a current setting circuit". As is the case with the first embodiment, an operation unit 31 obtains a writing information $V_n$ with reference to a lookup table 32 on the basis of the writing information $V_{n-1}$ and image information $D_n$. The writing information $V_n$ is voltage-to-current converted by a voltage-current conversion circuit (Gm circuit) 45. The voltage-current conversion circuit 45, for example, causes a part of current flowing into the information line to flow into a resistor to detect voltage across the resistor and thereby can convert the current into voltage.

In the present embodiment, the column current control circuit may be formed on the same substrate as the TFT substrate or may be formed as another IC. Even digital information can be used as the information referred to by the operation circuit in the present embodiment.

Although the display apparatus using an EL element is taken as an example in the description of the present embodiment, the display apparatus of the present invention is not limited to this example. The present invention can be applied to any apparatus as far as it can control the display of each pixel by current signal.

Fifth Embodiment

The display apparatus of the above embodiments can form an information processing apparatus. The information processing apparatus realizes a cellular phone, mobile computer, still camera, video camera or plural functions thereof. The information processing apparatus has an information input unit. For example, a cellular phone includes an antenna as an information input unit. A PDA or a mobile computer includes an interface unit for network as an information input unit. An information display apparatus such as a still camera or a video camera includes a sensor unit (or an image capturing unit) using a CCD or CMOS as an information input unit.

A digital camera is described below as a suitable exemplary embodiment of the present invention.

Figure 15:
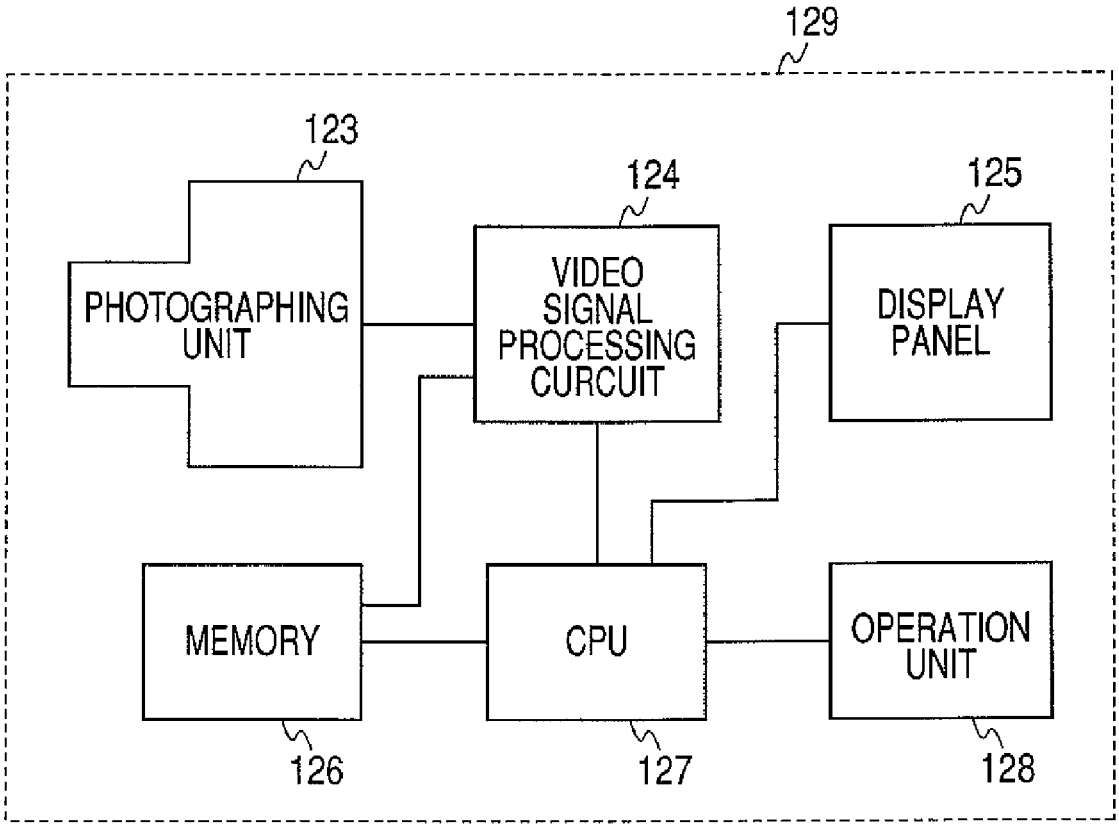
FIG. 15 is a block diagram of an example of a digital still camera.

FIG. 15 is a block diagram of an example of a digital still camera. The entire system 129 of the digital still camera includes a photographing unit 123 for capturing an object, video signal processing circuit 124, display panel 125, memory 126, CPU 127 and operation unit 128. A video signal captured by the photographing unit 123 or stored in the memory 126 is processed in the video signal processing circuit 124 and can be seen on the display panel 125. The CPU 127 controls the photographing unit 123, memory 126 and video signal processing circuit 124 according to the input from the operation unit 128 to perform capturing an image, recording, reproducing and displaying suited for situations.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-181672, filed on Jun. 30, 2006, which is hereby incorporated by reference herein in its entirety.

What is claimed is:

1. An active matrix-type display apparatus comprising: pixel circuits arranged in a row and a column directions; a column current control circuit that generates a current signal; an information line that transmits the current signal from the column current control circuit to the pixel circuits arranged in the column direction; and a light emitting element that is supplied with current corresponding to the current signal, from one of the pixel circuits, wherein the column current control circuit has a latch circuit to store an information, and wherein the column current control circuit compares the stored information in the latch circuit with an information newly input into the column current control circuit, converts the newly input information to a converted information according to the comparison result and generates the current signal on the basis of the converted information; wherein the column current control circuit includes a lookup table for storing a compensation information determined from the newly input information and the information stored in the latch circuit and outputs the converted information such that the compensation information is added to the newly input information; and the operation circuit sets V.sub.n to be V.sub.n=D.sub.n−.alpha. (where, .alpha. is a constant value) if D.sub.n−V.sub.n−1 is equal to or greater than a first setting value, to be V.sub.n=D.sub.n−.beta. (where, .beta. is a constant value) if D.sub.n−V.sub.n−1 is equal to or smaller than a second setting value and to be V.sub.n=D.sub.n if D.sub.n−V.sub.n−1 is smaller than the first setting value and larger than the second setting value, thereby outputting the set V.sub.n, where D.sub.n is the newly input image information, V.sub.n−1 is the converted information stored in the latch circuit and V.sub.n is the converted information output from the operation circuit.

2. The active matrix-type display apparatus according to claim 1, wherein the column current control circuit generates compensation information for compensating the generated current signal.

3. An information processing apparatus comprising the active matrix-type display apparatus according to claim 1, a photographing unit that captures an object and a video signal processing unit that processes a signal captured by the photographing unit, wherein a video signal subjected to signal processing by the video signal processing unit is displayed by the active matrix-type display apparatus.

* * * * *